US006913534B2

(12) United States Patent
DeFrees-Parrott et al.

(10) Patent No.: US 6,913,534 B2
(45) **Date of Patent: *Jul. 5, 2005**

(54) GAMING MACHINE HAVING A LOTTERY GAME AND CAPABILITY FOR INTEGRATION WITH GAMING DEVICE ACCOUNTING SYSTEM AND PLAYER TRACKING SYSTEM

(76) Inventors: Troy DeFrees-Parrott, 11535 E. Ranch Gate Rd., Scottsdale, AZ (US) 85255; John P. Meekins, 1925 Winding Oaks Way, Naples, FL (US) 34109

( * ) Notice: Subject to any disclaimer, the term of this patent is extended or adjusted under 35 U.S.C. 154(b) by 0 days.

This patent is subject to a terminal disclaimer.

(21) Appl. No.: 09/848,473

(22) Filed: May 3, 2001

(65) Prior Publication Data

US 2001/0036855 A1 Nov. 1, 2001

Related U.S. Application Data

(63) Continuation-in-part of application No. 09/691,580, filed on Oct. 18, 2000, now abandoned, which is a continuation-in-part of application No. 09/609,828, filed on Jul. 5, 2000, now abandoned, which is a continuation-in-part of application No. 09/517,999, filed on Mar. 2, 2000, now Pat. No. 6,685,563.

(60) Provisional application No. 60/202,017, filed on May 4, 2000.

(51) Int. Cl.[7] ..... A63F 9/24

(52) U.S. Cl. ..... 463/17; 273/269

(58) Field of Search ..... 463/16–22, 12, 463/13, 25–27, 29; 273/138.1, 139, 138.2, 143 R

(56) References Cited

U.S. PATENT DOCUMENTS

| | | | | |
|---|---|---|---|---|
| 4,157,829 A | | 6/1979 | Goldman | |
| 4,283,709 A | | 8/1981 | Lucero et al. | 340/147 R |
| 4,833,307 A | | 5/1989 | Gonzalez-Justiz | |
| 4,856,787 A | * | 8/1989 | Itkis | 273/237 |
| 4,871,171 A | | 10/1989 | Rivero | |
| 5,259,613 A | * | 11/1993 | Marnell, II | 463/42 |
| 5,324,035 A | | 6/1994 | Morris et al. | 273/138 |
| 5,342,047 A | | 8/1994 | Heidel | |
| 5,344,144 A | | 9/1994 | Canon | 273/138 |
| 5,380,007 A | | 1/1995 | Travis | |
| 5,393,057 A | * | 2/1995 | Marnell, II | 463/13 |
| 5,398,932 A | | 3/1995 | Eberhardt et al. | 273/138 |
| 5,505,449 A | | 4/1996 | Eberhardt et al. | 273/138 A |
| 5,564,700 A | | 10/1996 | Celona | 463/27 |
| 5,586,937 A | | 12/1996 | Menashe | 463/41 |
| 5,611,730 A | | 3/1997 | Weiss | 463/20 |
| 5,639,088 A | | 6/1997 | Schneider et al. | 273/138.2 |
| 5,645,486 A | | 7/1997 | Nagao | |
| 5,655,961 A | | 8/1997 | Acres et al. | 463/27 |
| 5,685,775 A | | 11/1997 | Bakoglu et al. | 463/41 |
| 5,743,800 A | * | 4/1998 | Huard et al. | 463/16 |
| 5,766,076 A | | 6/1998 | Pease et al. | 463/27 |
| 5,772,510 A | | 6/1998 | Roberts | |
| 5,810,664 A | | 9/1998 | Clapper | |
| 5,813,911 A | | 9/1998 | Margolin | |
| 5,823,874 A | | 10/1998 | Adams | 463/17 |
| 5,836,817 A | * | 11/1998 | Acres et al. | 463/16 |

(Continued)

FOREIGN PATENT DOCUMENTS

GB 2258519 A 12/1992

OTHER PUBLICATIONS

U.S. Appl. No. 60/196,827.*

*Primary Examiner*—Mark Sager
(74) *Attorney, Agent, or Firm*—Raymond A. Nuzzo

(57) ABSTRACT

A method of operating a gaming system. The method comprises the steps of providing a system comprising at least one casino game of chance and a lottery game device that provides a lottery game, providing a player with an opportunity to play the casino game, and providing the player with an opportunity to play the lottery game upon the occurrence of a predetermined event during play of the casino game.

2 Claims, 5 Drawing Sheets

U.S. PATENT DOCUMENTS 5,848,932 A 12/1998 Adams ..... 463/20
5,851,148 A 12/1998 Brune et al. ..... 463/25
5,855,515 A 1/1999 Pease et al. ..... 463/27
5,876,284 A 3/1999 Acres et al. ..... 463/25
5,882,261 A 3/1999 Adams ..... 463/20
5,885,158 A 3/1999 Torango et al. ..... 463/27
5,908,354 A 6/1999 Okuniewicz
5,934,672 A 8/1999 Sines et al. ..... 273/143 R
5,941,771 A 8/1999 Haste
5,984,782 A 11/1999 Inoue ..... 463/20
6,003,867 A 12/1999 Rodesch et al. ..... 273/143 R
6,004,207 A 12/1999 Wilson, Jr. et al. ..... 463/20
6,033,307 A 3/2000 Vancura ..... 463/20
6,050,895 A * 4/2000 Luciano et al. ..... 463/7
6,059,289 A 5/2000 Vancura ..... 273/143 R
6,071,190 A 6/2000 Weiss et al. ..... 463/25
6,080,062 A 6/2000 Olson
6,110,043 A 8/2000 Olsen ..... 463/27
6,113,098 A 9/2000 Adams
6,146,276 A 11/2000 Okuniewicz
6,159,095 A 12/2000 Frohm
6,173,955 B1 * 1/2001 Perrie et al. ..... 463/20
6,220,961 B1 4/2001 Keane
6,224,484 B1 5/2001 Okuda
6,251,014 B1 6/2001 Stockdale
6,319,125 B1 * 11/2001 Acres ..... 463/25
6,338,678 B1 1/2002 Seelig
6,358,151 B1 3/2002 Enzminger
6,503,147 B1 1/2003 Stockdale
6,524,184 B1 2/2003 Lind
6,533,660 B2 3/2003 Seelig
6,582,307 B2 6/2003 Webb
6,585,589 B2 * 7/2003 Okuniewicz ..... 463/17
6,648,753 B1 11/2003 Tracy
6,733,385 B1 5/2004 Enzminger
6,746,330 B2 6/2004 Cannon
6,764,396 B2 7/2004 Seelig

* cited by examiner

GAMING MACHINE HAVING A LOTTERY GAME AND CAPABILITY FOR INTEGRATION WITH GAMING DEVICE ACCOUNTING SYSTEM AND PLAYER TRACKING SYSTEM

CROSS REFERENCE TO RELATED APPLICATIONS

This application claims the benefit of commonly owned and copending U.S. Provisional Application Ser. No. 60/202,017, filed May 4, 2000.

This application also is a continuation-in-part of commonly owned U.S. application Ser. No. 09/691,580, filed Oct. 18, 2000, now abandoned which is a continuation-in-part of commonly owned U.S. application Ser. No. 09/609,828, filed Jul. 5, 2000, now abandoned which is a continuation-in-part of commonly owned U.S. application Ser. No. 09/517,999, filed Mar. 2, 2000 now U.S. Pat. No. 6,685,563.

BACKGROUND OF THE INVENTION

1. Field of the Invention

The present invention relates to gaming machines.

2. Problem to be Solved

Gaming machines or devices such as mechanical, electronic or video slot machines, video lottery terminals, video poker machines, video black jack, etc. have become very popular at casinos and lottery locations. Prospective players are always looking for new gaming machines that can provide the players with additional payouts above the payouts of the base game. Players also look for gaming machines that are relatively more entertaining. On the other hand, casinos and wagering establishments are interested in gaming machines that will (i) attract more players, (ii) encourage player loyalty, and (iii) increase revenues to the casinos and wagering establishments. What is needed is a new and improved gaming machine that meets the needs of the players and casinos or wagering establishments.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which.

SUMMARY OF THE INVENTION

Figure 1:
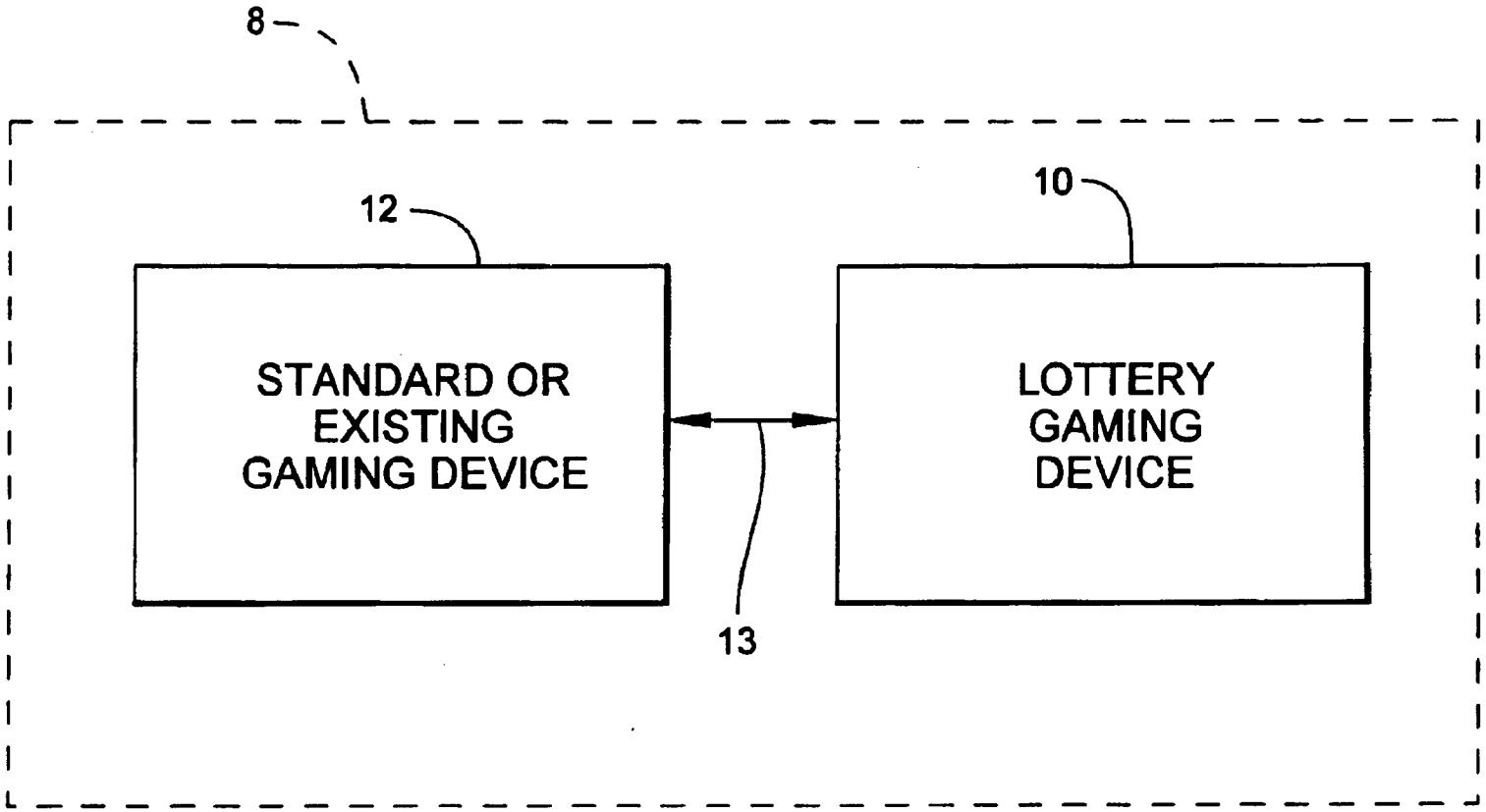
FIG. 1 is a block diagram illustrating a gaming machine of the present invention which generally comprises a standard gaming device interconnected with a lottery gaming device.

The present invention is directed to the provision of a lottery game to every POS or point of play in a casino so that everyone receives an opportunity to win a large progressive prize every time they gamble, spend money or use points, complementary dollars, earned-player points, etc.

In a preferred embodiment, the lottery game is a numbers based game wherein a computer system or mechanical machine selects the winning numbers. If one or more of the winning numbers match the player's chosen numbers, then the player wins.

However, the lottery game can take on other configurations, e.g. video pull tab, spin the wheel, video scratch card, etc.

In one embodiment, the present invention is implemented as a software-based lottery module that integrates into a casino's existing LAN or WAN systems.

In accordance with the present invention, predetermined events must occur in order for a player to enter the lottery drawing or to play a lottery game. In one embodiment, the predetermined events are related to the play of a casino game. For example, a player may be eligible to enter the lottery drawing or play a lottery game when:

a) a particular indicia on a slot machine reel arrives at the payline;

b) a winning combination of indicia of slot machine reels arrive at the payline;

c) a player acquires a particular card or hand of cards;

d) a player places a maximum bet on a game;

e) a player places a bet between a minimum bet and a maximum bet;

f) a player pulls the lever of a slot machine a predetermined number of times;

g) a player activates any electronic casino game a predetermined number of times; or h) a casino patron makes a particular purchase in the casino.

The predetermined events described above are just examples. The ensuing description describes other methods for advancing a player or patron to the lottery game.

In one embodiment, the lottery game module is integrated into the casino's LAN that allows for players or patrons to use their player tracking/charge card at all POS locations, i.e. bar, restaurant, pool, etc. Every time a player or patron spends at least a dollar, he or she is automatically entered into the lottery drawing.

Thus, in a preferred embodiment, the lottery game module is realized by integrating the lottery type game(s) into an existing player tracking and slot accounting system from well known suppliers such as CDS (Casino Data Systems), Bally SDS, IGT Smart System, Mikohn's Pit Track and Slot Accounting System, GSI, LSI and others. Specifically, the lottery game is integrated into the existing player tracking keyboard and display unit without the need to add any equipment to each gaming machine.

In another embodiment of the invention, the lottery game is not integrated into an existing player tracking system. Instead, the lottery game is configured to run on both the casino's existing LAN and WAN with each gaming machine configured to have a player interface to enable the player to enter the lottery game.

In one embodiment, the lottery game is configured as a Quick Pick lottery and the Quick Pick numbers are erased after each play and replaced with new quick pick numbers or a players chosen numbers.

In another aspect of the present invention, existing player tracking and slot accounting systems having the lottery game integrated therein are linked to a plurality of properties or locations (e.g. casinos, restaurants, etc.) via the internet.

As used herein, the term "predetermined event" is defined as an event that can (i) be established randomly with the use of an RNG (random number generator), or (ii) be preset in the software used in the gaming machine or gaming system of the present invention.

As used herein, the term "predetermined criteria" is defined as criteria that can (i) be established randomly, or (ii) be preset in the software used in the gaming machine or gaming system of the present invention.

As used herein, the term "predetermined cumulative amount of time played" is defined as an amount of time that can (i) be established randomly, or (ii) be preset in the software used in the gaming machine or gaming system of the present invention.

As used herein, the term "predetermined cumulative amount of dollars (or coins, credits, etc.) wagered" is defined as an amount of dollars that can (i) be established randomly, or (ii) be preset in the software used in the gaming machine or gaming system of the present invention.

DETAILED DESCRIPTION OF THE INVENTION

In describing the preferred embodiments of the present invention, reference will be made herein to FIGS. 1–5 of the drawings in which like numerals refer to like features of the invention.

Referring to FIG. 1, there is shown gaming machine 8 of the present invention. Gaming machine 8 generally comprises lottery game device 10 and existing or standard gaming device 12. Lottery game device 10 is in electronic data communication with standard gaming device 12 via data communication link 13. Communication link 13 can comprise any one of a number of devices or mediums for effecting electronic data communication, e.g. computer data bus, cable, etc. Existing gaming device 12 can be any type of gaming device, e.g. mechanical, electronic or video slot machines, video poker machines, video black jack, "spin-the-reel" gaming device, etc. In order to play standard gaming device 12, a player must insert coins into the coin slot and or play credits In one embodiment, lottery game device 10 of the present invention is removably mounted or attached to the top of standard gaming device 12. In another embodiment, lottery game device 10 is mounted within standard gaming device 12. In yet another embodiment, lottery game device 10 is integral with the electronic circuitry of standard gaming device 12.

In accordance with the present invention, when predetermined events have occurred the player is advanced to a lottery game provided by lottery game device 10 wherein the lottery game enables the player to play for winnings that are in addition to the winnings on the standard gaming device 12. The lottery game can be particular to the casino itself wherein only the players in the casino can participate and the jackpot is payable by the casino and or the lottery game can be connected to any number of casinos so all players can participate and the jackpot is payable by the lottery game operator. The lottery game can also be any one of several popular lottery games offered by many states, e.g. Lotto, Bingo, Keno, Power Ball, Pick-3, Pick-4, Pick-5, Pick-6, Scratch Card, video pull-tab, Spin the Wheel, etc. or other games commonly offered on lottery systems. In some of the aforementioned lottery games, a player picks three, four, five, six or more numbers out of a total of 49 or more numbers.

In one embodiment of the present invention, lottery game device 10 generates:

a) a randomly selected coin input threshold that defines a number of coins required for a player to advance to the lottery game provided by lottery game device 10, and/or b) a randomly selected credits played threshold required for a player to advance to the lottery game provided by lottery game device 10, and/or c) a plurality or multiplicity of coin-input and/or credit-input thresholds wherein each threshold defines a number of coins and/or credits required for a player to advance to the lottery game provided by lottery game device 10 and wherein all of the coin-input and/or credit-input thresholds must be met in order for a player to advance to the lottery game.

In a preferred embodiment of the present invention, when a player inputs a number of coins into standard gaming device 12 that satisfies either conditions (a) or (c) above, or when the player's credit complies with condition (b) above, lottery game device 10 generates control signals that shift standard gaming device 12 into a generally inoperative state such that the player cannot play device 12, and enables the player to play the lottery game provided by lottery game device 10 for a range of bonus payouts that are in addition to the payout of standard gaming device 12. The aforementioned control signals are described in detail in the ensuing description. Other predetermined events which advance the player to the lottery game are described in the ensuing description.

In order to facilitate understanding of the present invention, the ensuing description is in terms of the standard gaming device 12 comprising a mechanical slot machine. However, it is to be understood that standard gaming device 12, as stated above, can be configured as an electronic or a video slot gaming device, some of which are shown in U.S. Pat. Nos. 5,934,672, 5,984,782, 6,003,867 and 6,004,207, the disclosures of which are incorporated herein by reference. Standard gaming device 12 can also be configured as a video poker gaming device, a video black jack gaming device, a "spin-the-reel" gaming device, European AWP (amusement with prizes) machines, etc.

Figure 2:
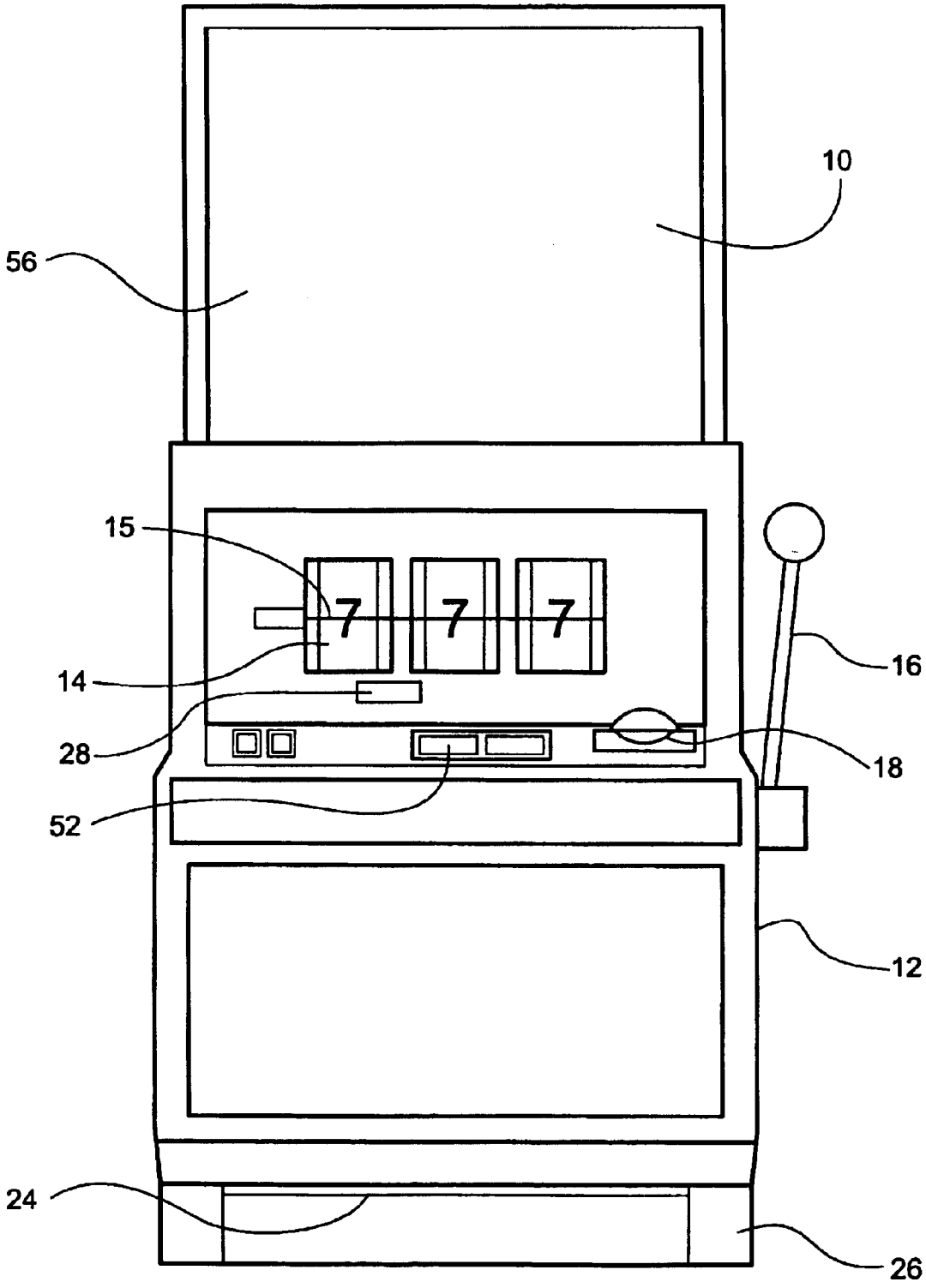
FIG. 2 is a side elevational view illustrating the interconnection of a standard gaming device and lottery gaming device, both of which being depicted in FIG. 1.

Referring to FIG. 2, lottery gaming device 10 is mounted upon or attached to the top standard gaming device 12. Standard gaming device 12 generally comprises rotatable reels 14 wherein each reel comprises a plurality of indicia on the periphery thereof. Standard gaming device 12 further includes mechanical lever 16 and coin slot 18. Each reel 14 is designed to rotate and then stop. If the combination of indicia displayed at pay-line 15 is one of a predetermined plurality of winning indicia sets, then the player is provided with a winning payout either through coin exit chute 24 which deposits winnings into a coin tray 26 or by increasing the player's credits on a credit meter 28. It is to be understood that standard gaming device 12 may have other configurations. Specifically, a push-button can be used in place of lever 16. Additionally, instead of coin slot 18, device 12 may use debit or credit cards (i.e. "cashless machines").

Figure 3:
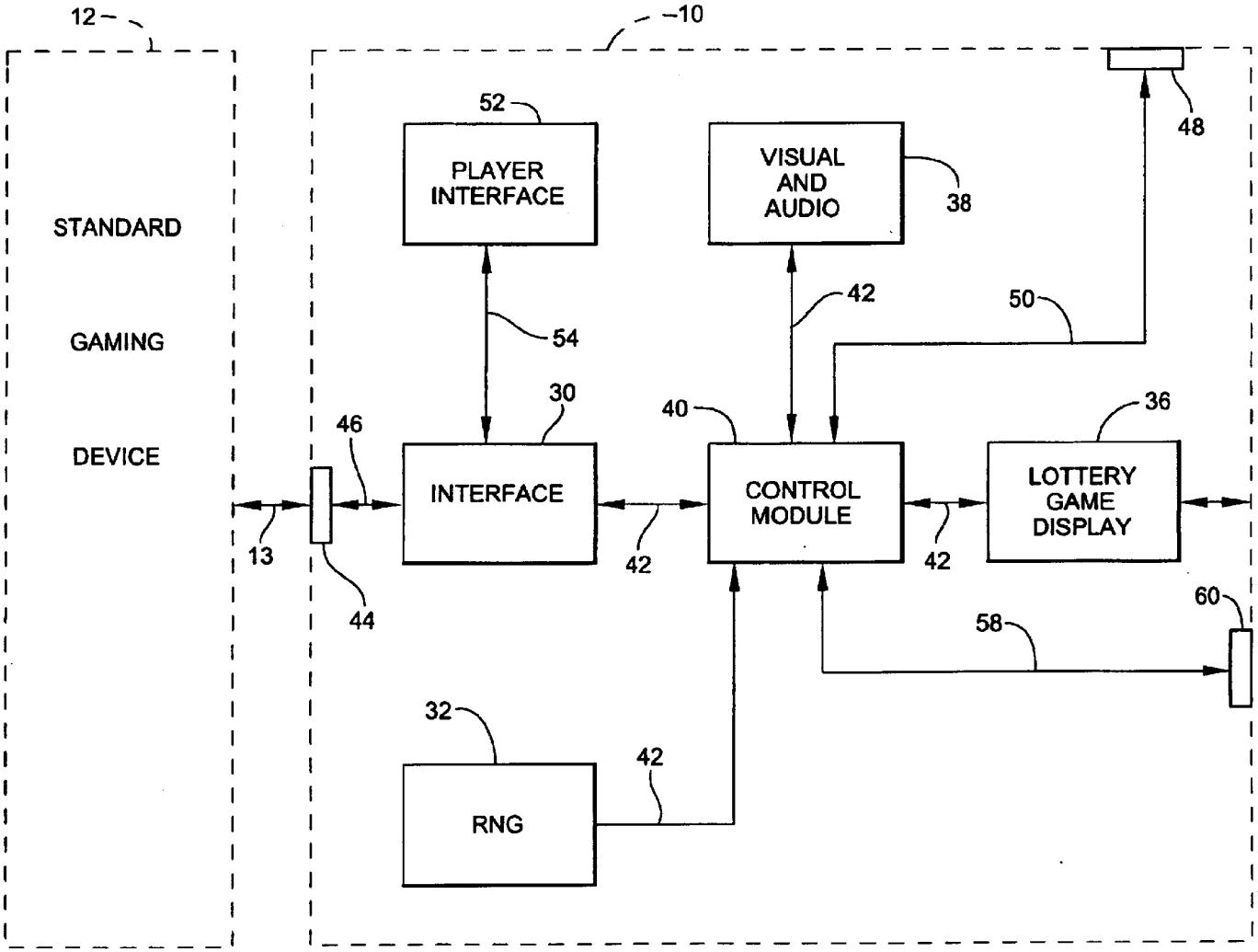
FIG. 3 is a block diagram of the lottery game device shown in FIGS. 1 and 2.

Referring to FIG. 3, there is shown a functional block diagram of lottery game-device 10 of the present invention. Lottery game device 10 general comprises interface module 30, random number generator module 32, lottery game display 36, visual and audio module 38 and control module 40.

Control module 40 is in electronic data communication with all of the aforementioned modules via bi-directional data busses 42. Control module 40 generally comprises a microprocessor with EPROM (erasable programmable read-only-memory) and RAM (random access memory) capability. Such microprocessors are commercially available from a variety of companies such as Intel, Advanced Microdevices, National Semiconductor, etc. Control module 40 further comprises timing and clock circuitry. The functions of control module 40 include (i) effecting electronic data communication between all modules, (ii) controlling the function of all other modules, (iii) producing timing and synchronization signals, (iv) producing electronic signals that render standard gaming device 12 inoperative, (v) storing lottery game termination criteria, and (vi) providing power to all other modules.

Lottery game device 10 further includes interface connector 44 and data bus 46 that effects data transfer between interface module 30 and connector 44. Connector 44 is configured for electronic connection to data communication link 13. Link 13 is in electronic data communication with timing and control circuitry located within standard gaming device 12. Lottery game device 10 further includes data input connector 48 and data bus 50 that is connected between connector 48 and control module 40. Control module 40 is programmed by data received from a central or mainframe computer via interface connector 48 an data bus 50. Such data represents the protocol according to which standard gaming device 10 and lottery game device 10 interact. In one embodiment, a portion of the data used to program control module 40 is generated by RNG 32.

Lottery game device 10 also includes player interface 52 that provides the player with an enabling means such as a key pad, card reader, push button, joy stick, video-game pad arm and/or "touch screen" to activate and thus play the lottery game provided by lottery game device 10. Data bus 54 effects data communication between player interface 52 and interface module 30. Lottery gaming device 10 further includes circuitry and other electromechanical devices to effect generation and distribution of lottery tickets, such circuitry and devices being well known in the art.

Lottery gaming device 10 further comprises data bus 58 that effects data communication between control module 40 and interface connector 60. Connector 60 is used to effect data communication between control module 40 and a central lottery computer located at a remote site. As a result of such a configuration, lottery device 10 can receive lottery gaming data directly from the central lottery computer.

Thus, lottery game data can be inputted into lottery game device 10 from either a central computer or floor controller located at the casino via connector 48 and data bus 50, or a central computer located at a remote location via interface connector 60 and data bus 58.

Referring to FIG. 3, interface module 30 comprises data receiver and driver circuitry for transmitting and receiving signals to and from, respectively, standard gaming device 12, control module 40 and user interface 52. Thus, any data signals that interface module 30 receives from standard gaming device 12 and player interface 52 are routed to control module 40. Similarly, any data signals that interface module 30 receives from control module 40 can be routed to standard gaming device 12 and/or player interface 52. In one embodiment, data link 13 is hardwired to signal input and output ports of various components of standard gaming device 12, e.g. coin acceptor, ticket printer device, coin hopper, button panel, etc. In another embodiment, data link 13 is directly in electronic data communication with the microprocessor unit (or MPU) of standard gaming device 12.

In a preferred embodiment, control module 40 receives lottery game and other data from a central or mainframe computer system via data bus 58 and interface connector 60. Once control module 40 receives the data received from the central or mainframe lottery computer system, control module 40 controls lottery game display 36 and player interface 52 so as to enable play of the lottery game. In such a configuration, control module 40 routes any electronic signals generated by interface 52 to data bus 58 for input into the central computer. Thus, if a player uses a keypad to input a particular lottery number, control module 40 receives such data from interface 52 and routes it to data bus 58.

Lottery game display 36 displays information about the lottery game to which the player advances once the predetermined events have occurred. Such information includes the number of players competing for the jackpot, the amount of the jackpot, the opportunity to win lesser amounts, and the selected lottery number or numbers inputted by the player. Lottery game display 36 can be configured as a video monitor, liquid crystal display ("LCD") or other suitable display device.

Standard gaming device 12 outputs a signal comprising an electrical pulse every time a player inserts a coin that registers and/or plays a credit, etc. Interface module 30 receives these "pulse" signals from standard gaming device 12 and outputs a data signal, for input to control module 40, that represents the current total amount of "pulses". Thus, this data signal represents the total amount of coins accepted and/or credits played for all consecutive plays. Standard gaming device 12 also outputs an additional signal that represents the amount of credit a player has accrued during play. Interface module 30 receives this additional signal and routes this signal to control module 40.

Random number generator ("RNG") 32 is in data communication with control module 40 and outputs totally impartial, random data signals that are stored in a data storage device (e.g. EPROM, RAM, cache memory, etc.) which is in control module 40. These random data signals provide criteria that is directly related to the player's advancement to the lottery game provided by lottery game device 10. The specific random data signals generated by RNG 32 are discussed below in detail. RNG 32 outputs the totally impartial, random data signals upon receipt of a control signal (or clock signal) from control module 40. In an alternate embodiment, RNG 32 comprises a plurality of random number generators that generates random data signals that define criteria for advancing a player from the game provided by standard gaming device 12 to the lottery game provided by lottery game device 10.

Referring to FIG. 1, video and audio module 38 is in data communication with control module 40 and includes circuitry that provides video and audio information, e.g. music, flashing lights, recorded voice messages, video images, etc. to inform the player that the lottery round has begun and that the player may now initiate play of the lottery game. Module 38 can also be configured to provide audio entertainment as the player plays the lottery game. In one embodiment, module 38 includes a video monitor and the necessary circuitry to provide the information visually. In another embodiment, the information is provided on a portion of lottery game display 36.

In an alternate embodiment, the coin-input and/or credit-input thresholds are pre-set in either the ROM, PROM or RAM of control module 40. In such an embodiment, the coin-input and/or credit-input thresholds are inputted into connector interface 48 by an external computer.

In an alternate embodiment of the present invention, each standard gaming device 12 includes an electronic module to enable a plurality of gaming devices 12 to be linked to a floor controller or mainframe computer over a current loop network. Such a configuration is shown in U.S. Pat. No. 5,655,961, the disclosure of which is incorporated herein by reference.

In alternate embodiment, lottery device can be configured as a video lottery terminal. Video lottery terminals are described in U.S. Pat. Nos. 5,398,932 and 5,505,449 the disclosure of which is incorporated herein by reference.

In accordance with the present invention, a player is advanced to a lottery game provided by lottery game device 10 upon the occurrence of predetermined events. The ensuing description describes one method for advancing the player to the lottery game.

a) The first step of the method of the present invention entails the generation of a matrix or two dimensional array that comprises a plurality of numbers and events wherein each event corresponds to a specific number. Table I shown below illustrates the aforementioned matrix.

TABLE I

| Number (N) | Event |
|---|---|
| 1 | EVENT 1 |
| 2 | EVENT 2 |
| 3 | EVENT 3 |
| 4 | EVENT 4 |
| 5 | EVENT 5 |
| 6 | . |
| . | . |
| . | . |
| . | EVENT N-1 |
| N | EVENT N |

The Numbers (N) in Table I range can range between one and a billion, inclusive. For each number, there is a corresponding event. Each event can comprise any one of a number possible events. For example, an event can comprise a coin amount, credit amount, advancement to the lottery game, etc. Table I can be generated in several ways. In one embodiment, Table I is generated by an external computer (not shown) and then inputted into control module 40 via data bus 50 wherein it is stored in either the EPROM or RAM. In another embodiment, the "Number" column of Table I is already stored in the EPROM or RAM of control module 40 and the Events are randomly generated by RNG 32. In an embodiment, control module 40 prompts RNG 32 to randomly generate a number N times. Each random number generated by RNG 32 is inputted into control module 40 wherein it is used to access particular event information that is stored in memory at a memory address that corresponds to the number generated by RNG 32. The accessed event information is sequentially assigned to the numbers in the "N" column of Table I. For example, if control module 40 prompts RNG 32 a first time to generate a number and the actual number generated by RNG 32 is "567", this number is inputted into control module 40 which effects retrieval of event information, e.g. "10 Coin Win", from a memory location having an address that corresponds to "567". Table II shows one particular example of Table I having specific "Event" information.

TABLE II

| Number (N) | Event |
|---|---|
| 1 | 20 Coin Win |
| 2 | 5 Coin Win |
| 3 | 10 Coin Win |

TABLE II-continued

| Number (N) | Event |
|---|---|
| 4 | 15 Coin Win |
| 5 | Advance To Lottery Game |
| 6 | . |
| . | . |
| . | . |
| . | 50 Coin Win |
| N | Advance To Lottery Game |

Once the matrix, as illustrated by Tables I and II above, are generated, lottery gaming device 10 is ready for use.

b) The next step entails applying power to standard gaming device 12 and enabling players to play standard gaming device 12. This is accomplished by the players inserting coins into coin slot 18 and/or by playing credits and activating lever 16 or a button, etc.

c) Once the first the coin is inserted into coin slot 18 or a credit is played, gaming device 12 outputs a pulse that is inputted into interface module 30 via data bus 46. (In an alternate embodiment, device 12 outputs a signal that represents the amount of accrued credit).

d) Interface module 30 then transfers the received pulse to control module 40. In response, control module 40 outputs a clock or enabling signal to RNG 32 thereby causing RNG 32 to randomly generate a number. This random number is inputted into control module 40 wherein it is matched to the same number in the "Number N" column of Table I. Control module 40 then locates the event corresponding to the particular Number N. Once the particular event is located, control module 40 outputs control signals to interface module 30 for transfer to standard gaming machine 12. These control signals control standard gaming machine 12 in accordance with the event. For example, if the event is "10 Coin Win", then the control signals control the circuitry within standard gaming machine 12 to output ten (10) coins through the coin chute 24 to coin tray 26.

e) If RNG 32 randomly generates a number that corresponds to the address of a memory location that stores the event "Advance To Lottery Game", control module 40 outputs a signal to interface module 30 that inhibits the operation of standard gaming device 12. This "inhibiting signal" configures standard gaming device 12 into an inoperative state. When in the inoperative state, standard gaming device 12 is not responsive to movement of the lever or handle (e.g. lever 16 on standard gaming device 12) or activation of the "spin" button.

f) In addition to the "inhibiting signal" outputted by control module 40, module 40 outputs an activation signal to visual and audio module 38. In response, module 38 advances the player to the lottery game through video and audio stimulation. In one embodiment, any "push buttons" or "touch screens" on player interface 52 are illuminated so as to guide the player as to the first step in playing the lottery game. In an alternate embodiment, an indicator is mounted to standard gaming device 12 and electrically connected to interface connector 44. The indicator informs the player that he or she is now entering the lottery round provided by lottery game device 10.

g) Next, control module 40 outputs activation signals to lottery game display 36. In response to the activation signal, module 36 is activated and displays the lottery game on the display, i.e. video monitor. The lottery game is now ready to be played by the player.

h) The player then uses player interface 52 to play the lottery game. Specifically, the player uses a keypad connected to interface 52 to input his or her selected or favorite lottery number. When the player activates the keypad, electrical "pulse" signals are sent from player interface module 52 to interface module 30. Module 30 routes these signals to control module 40. Control module 40 routes these signals to lottery game display 36 as well as data bus 58 for input into the central lottery computer to effect play of the lottery game but also keeps track of how many pulses it receives from player interface 52.

i) Next, lottery game device 10 generates a lottery ticket having the player's selected lottery number. In alternate embodiment, the player's identification card has the player's favorite lottery numbers encoded thereon. The player inserts his or her card into the card reader. The player then uses the keypad to input his instructions that enable the card reader to read the lottery numbers from player identification card. The card reader reads the encoded lottery numbers and transmits this data to control module 40.

In one embodiment, the lottery pay-out, if any, is in terms of credit that is added to a credit meter located in lottery game device 10. In a further embodiment, the lottery payout is in terms of credit which is added to the player's accrued credit that was previously earned when playing the standard gaming device 12. Data representing the winning lottery number is then generated by the central lottery computer and inputted into interface connector 60. Control module 40 then controls lottery game display 36 to display the winning lottery numbers. If the player is a winner, control module 40 then outputs a signal to lottery game display 36 and visual and audio module 38 to provide video and audio information that informs the player he or she is a winner.

In yet another embodiment, lottery game device 10 includes a CD-ROM drive in electronic data communication with control module 40. Lottery game device 10 is programmed via the software on CD-ROM inputted into the CD-ROM drive. The CD-ROM contains data that represents the coin-in and credit-played thresholds. In order to change the coin-in and credit-played thresholds, the CD-ROM currently loaded in the CD-ROM is removed and replaced with a CD-ROM having the desired coin-in and credit-played thresholds.

In accordance with the present invention, the ensuing description pertains to an alternate method for advancing a player to the lottery game provided by lottery game device 10. Each step of this alternate method is now described in detail.

a) The first step of the method of the present invention entails the generation of a matrix or two dimensional array that comprises a plurality of numbers and amounts of Elapsed Time T wherein each amount of Elapsed Time T corresponds to a specific number. Table III shown illustrates the aforementioned matrix.

TABLE III

| Number (N) | Elapsed Time T |
|---|---|
| 1 | $T_1$ |
| 2 | $T_2$ |
| 3 | $T_3$ |
| 4 | $T_4$ |
| 5 | $T_5$ |
| . | . |
| . | . |
| . | . |
| N | $T_N$ |

The Numbers (N) in Table III range can range between one and a billion, inclusive. For each number, there is a corresponding amount of Elapsed Time T. Table III can be generated in several ways. In one embodiment, Table III is generated by an external computer (not shown) and then inputted into control module 40 via data bus 50 wherein it is stored in either the EPROM or RAM. In another embodiment, the "Number" column of Table III is already stored in the EPROM or RAM of control module 40 and the amounts of Elapsed Time T are randomly generated by RNG 32. In such an embodiment, control module 40 prompts RNG 32 to randomly generate a number N times. Each random generated by RNG 32 is inputted into control module 40 wherein it is used to access a particular amount of Elapsed Time that is stored in memory at a memory address that corresponds to the number generated by RNG 32. The accessed Elapsed Time information is sequentially assigned to the numbers in the "N" column of Table III. For example, if control module 40 prompts RNG 32 a first time to generate a number and the actual number generated by RNG 32 is "567", this number is inputted into control module 40 which effects retrieval of Elapsed Time information, e.g. "10 Minutes", from a memory location having an address that corresponds to "567".

Table IV shows one particular example of Table III having specific Elapsed Time information. In order to facilitate understanding of the present invention, the actual amounts of time shown in the column "Elapsed Times" are in minutes. However, it is to be understood that the amounts of Elapsed Time can be in seconds, hours, etc.

TABLE IV

| Number (N) | Elapsed Time |
|---|---|
| 1 | 20 Minutes |
| 2 | 5 Minutes |
| 3 | 0.75 Minutes |
| 4 | 1 Minute |
| 5 | . |
| 6 | . |
| . | . |
| . | 50 Minutes |
| N | 75 Minutes |

As previously described, control module 40 receives power and is programmed via power and data signals received from data input port 48 via data bus 50.

b) The next step entails applying power to standard gaming device 12 and enabling players to play standard gaming device 12. This is accomplished by the players inserting coins into coin slot 18 and/or by playing credits and activating lever 16 or a button, etc.

c) Once the first the coin is inserted into coin slot 18 or a credit is played, gaming device 12 outputs a pulse that is inputted into interface module 30 via data bus 46. (In an alternate embodiment, standard gaming device 12 outputs a signal that represents the amount of accrued credit).

d) Interface module 30 then transfers the received pulse to control module 40. In response, control module 40 (i) controls the timing circuitry to commence continuous recordation or monitoring of the actual elapsed time starting immediately after the first coin is inputted or the first credit is played, and (ii) outputs a clock or enabling signal to RNG 32 thereby causing RNG 32 to randomly generate a number. This random number is inputted into control module 40 wherein it is matched to the same number in the "Number N" column of Table III. Control module 40 then locates the amount of Elapsed Time corresponding to the particular Number N. Once the particular amount of Elapsed Time is located, control module 40 commences continuous comparison of the actual elapsed time, as monitored by the timing circuitry of control module 40, with the Elapsed Time stored in memory.

e) When the actual elapsed time is equal to the stored Elapsed Time, control module 40 outputs a signal to interface module 30 that inhibits the operation of standard gaming device 12. This "inhibiting signal" configures standard gaming device 12 into an inoperative state. When in the inoperative state, standard gaming device 12 is not responsive to any movement of the lever or handle (e.g. lever 16 on standard gaming device 12) or activation of the "spin" button.

f) In addition to the "inhibiting signal" outputted by control module 40, module 40 outputs an activation signal to visual and audio module 38. In response, module 38 advances the player to the lottery game through video and audio stimulation. In one embodiment, the keypad, push-buttons or touch-screens on player interface 52 are illuminated so as to guide the player as to the first step in playing the lottery game. In an alternate embodiment, an indicator is mounted to standard gaming device 12 and electrically connected to interface connector 44. The indicator informs the player that he or she is now entering the lottery round provided by lottery game device 10.

g) The player then uses player interface 52 to play the lottery game as previously described herein. When the player activates player interface 52, electrical "pulse" signals are sent from player interface module 52 to interface module 30. Module 30 routes these signals to control module 40. Control module 40 routes this signal to module 36 to effect play of the lottery game but also keeps track of how many pulses it receives from player interface 52. Thus, if control module 40 has been programmed to allow the player to play the lottery game a predetermined amount of times, control module 40 terminates the play of the lottery game when the number of times that the player has played the lottery game equals the predetermined amount stored in the RAM of control module 40.

In a preferred embodiment, any lottery winnings are distributed to the player in terms of credit that is added to a credit meter located in lottery game device 10. In a further embodiment, the lottery winnings are distributed as credit that is added to the player's accrued credit that was previously earned when playing the standard gaming device 12. In order to provide the player with the winnings, control module 40 outputs a signal to interface module 30 which transfers the signal to standard gaming device 12 in order to effect accrual of credit as discussed above. Control module 40 then outputs a signal to visual and audio module 38 to provide video and audio information that informs the player he or she is a winner.

In an alternate embodiment of the method of the present invention, lottery game device 10 is programmed to advance the player to the lottery game in a different manner. In such an embodiment, Table III is created or generated and stored in the same manner as described in step (a) above. Next, another array or 1×1 matrix of "winning numbers" is created. In one embodiment, the 1×1 matrix is programmed into control module 40 via data bus 50 and stored into the EPROM or RAM of control module 40. In another embodiment, control module 40 enables RNG 32 to generate a plurality of "winning numbers" which are stored in the EPROM or RAM of control module 40. Each winning number corresponds to a number in the "Number N" column in Table III.

Every time standard gaming machine 12 outputs a pulse as described in steps (c) and (d) above, control module 40 enables RNG 32 as to generate a number. Control module 40 then effects a comparison of this number to every number stored in the 1×1 array of "winning numbers". If the number generated by RNG 32 matches a winning number in the 1×1 array, then control module 40 compares that "winning number" to the same number stored in the "Number N" column of Table III in order to determine the corresponding Elapsed Time. As an example, Table V illustrates one possible 1×1 matrix.

TABLE V

| Winning Number (N) |
|---|
| 2 |
| 5 |
| 27 |
| 34 |
| 56 |
| 134 |
| . |
| . |
| . |
| M-1 |
| M |

Thus, for example, if once a pulse is received from standard gaming machine 12, as described in steps (c) and (d) above, control module 40 enables RNG 32 to generate a number and such number is "2", then control module 40 effects a comparison between the number "2" and every winning number stored in Table V above in order to determine if "2" is a winning number. As shown above, the number "2" is indeed a winning number. Control module 40 than scans Table IV above to determine the stored Elapsed Time associated with the number "2". As shown above in Table IV, the Elapsed Time associated with the number "2" is "5 Minutes". When the actual elapsed time equals 5 Minutes, control module 40 outputs a control signal that inhibits standard gaming machine 12 as described in step (e) above. The player then plays the lottery game as described in the steps above.

Although only one random number generator (i.e. RNG 32) has been described as generating data for use in advancing the player to the lottery game, it is to be understood that RNG 32 may comprise a plurality of random number generators to perform the functions described above in both embodiments of the method of the present invention.

In one embodiment, lottery game device 10 includes the necessary electronic circuitry and microprocessor to provide a graphically generated or pre-recorded periodic lotteries in which the player is entitled to participate. In another embodiment, lottery game device 10 comprises the appropriate electronic circuitry to receive transmissions from a primary central site that show a live real-time, pre-recorded or graphically generated lottery drawing.

Since the jackpot is a progressive jackpot, the winnings would most likely be substantially large. Wide-area progressive jackpots are also described in U.S. Pat. Nos. 5,611,730 and 5,655,961, the disclosures of which are incorporated herein by reference. Therefore, if a player should select a winning lottery number, payment is made to the player manually by the casino. In one embodiment, when a player wins the jackpot, control module 40 emits an electronic signal to a casino floor controller. In response, casino personnel would tender payment to the winner. In another embodiment, lottery game device 10 includes a device for printing a ticket which indicates that the player has won the jackpot. The player then redeems the ticket at the casino.

In a further embodiment, lottery game device 10 is configured for use with table games, e.g. Poker, Black Jack, etc. In such an embodiment, data communication link 13 is disconnected from interface connector 44 and lottery game device 10 is positioned on or near the gaming table so that player interface 52 is conveniently accessible to the player. The player is eligible to play the progressive jackpot lottery game if predetermined conditions are met. For example, the player can play the lottery game if:

a) the player's accumulated bets exceed a predetermined amount;

b) the player wins a predetermined amount of hands; or c) the player plays a predetermined amount of hands, regardless or wins, losses or accumulated bets.

Figure 4:
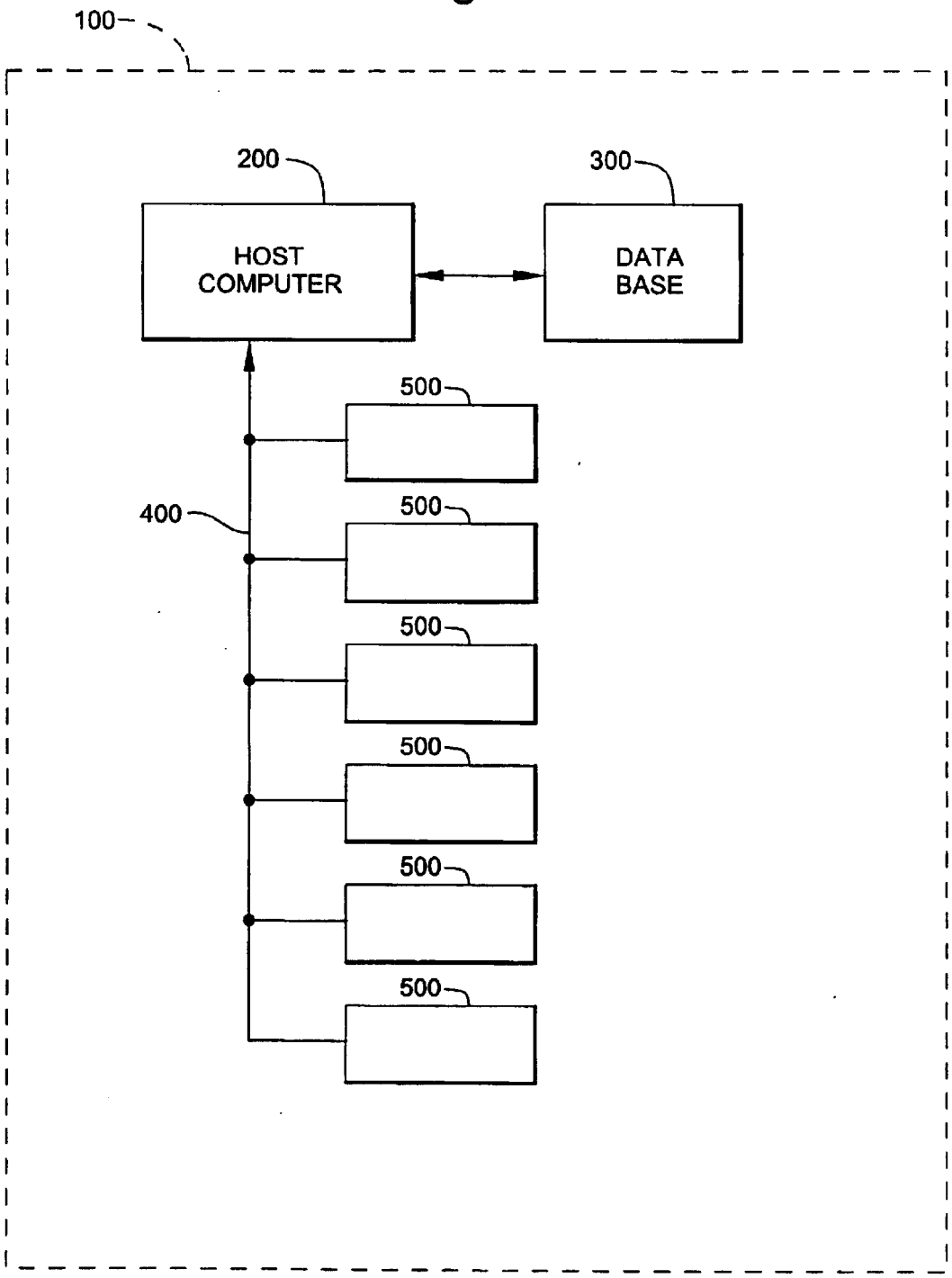
FIG. 4 is a block diagram of a networked gaming system in accordance with the present invention which utilizes a plurality of gaming machines, each of which being configured as the gaming device of FIG. 1.

Referring to FIG. 4, there is shown a further embodiment of the present invention. Gaming system 100 is configured to provide gaming machine accounting functions and player tracking. Gaming system 100 generally comprises host computer 200, data base 300, data bus 400 and a plurality of gaming machines 500. Host computer 200, data base 300, data bus 400 function as a wide-area network controller.

Each gaming machine 500 is generally comprised of a standard gaming device, such as standard gaming device 12 previously described herein, as well as a lottery game device, such as lottery game device 10, previously described herein. Each standard gaming device includes an electronic module that allows the standard gaming device to communicate with host computer 200. Such an electronic module is described in U.S. Pat. No. 5,655,961 which was previously described herein. Each lottery game device of gaming system 500 also includes a card reader for interpreting player identification information encoded on a player identification card. Such a card reader is described in the aforementioned U.S. Pat. No. 5,655,961. In one embodiment, the player's favorite lottery numbers are encoded on the player's identification card.

Referring to FIG. 4, host computer 200 is in data communication with data base 300 and data bus 400. Data bus 400 is in data communication with a plurality of gaming machines 500. Specifically, data bus 400 is in data communication with interface connector 48 of each gaming machine 500. In such a configuration, host computer 200 functions to program control module 40 of each gaming machine 500 as described above and to implement accounting functions regarding the activity of each gaming machine 500.

One significant feature of gaming system 100 is the capability to create an account for each player and for each gaming machine 500. Such accounts are created by host computer 200 and maintained and updated by database 300. Each time a player inserts his or her player identification card into the card reader of each gaming machine 500, the ensuing activity is monitored and stored in data base 300. Host computer 200 and database 300 also cooperate to monitor and store pertinent information relating to the functioning and operation of each gaming machine 500. Thus, system 100 allows for improved player tracking by recording each and every machine transaction including time of play, machine number, duration of play, coins in, coins out, credit played, hand paid jackpots, games played and bill validator information. System 100 also monitors and stores information pertaining to lottery numbers inputted into user interface 52 of each gaming machine 500, lottery tickets dispensed by the lottery game device of each gaming machine 500, a players' preferred or favorite lottery numbers, and each player's win/loss history. System 100 also stores any information pertaining to the operation and maintenance of each gaming machine 500. System 100 enables casinos to measure profitability as to particular ones of gaming machines 500.

Host computer 200 generally comprises a central processing unit (CPU), a read only memory (ROM), a random access memory (RAM), and a clock or timing module, all of which are not shown but which are well known in the field of computer processing systems. The CPU is preferably linked to each of the other listed components, either by means of a shared data bus, or dedicated connections. The CPU may be embodied as a single processor, or a number of processors operating in parallel. The ROM is operable to store one or more instructions which CPU is operable to retrieve, interpret and execute. The CPU preferably includes a control unit, an arithmetic logic unit (ALU), and a CPU local memory storage device, such as, for example, a stackable cache or a plurality of registers, in a known manner. The control unit is operable to retrieve instructions from the ROM. The ALU is operable to perform a plurality of operations needed to carry out instructions. The CPU local memory storage device is operable to provide high speed storage used for storing temporary results and control information.

In an alternate embodiment of the present invention, a node concept is used to link host computer 200 with a plurality of gaming machines 500. Such an embodiment would utilize a node having a non-volatile data storage capability and a communications capability for communicating with each of a plurality of gaming machines 500 coupled to the node. Such a node configuration is described in U.S. Pat. No. 4,283,709, the disclosure of which is incorporated herein by reference.

The accounting and player tracking functions are similar to those described in the aforementioned U.S. Pat. Nos. 4,283,709 and 5,655,961.

Figure 5:
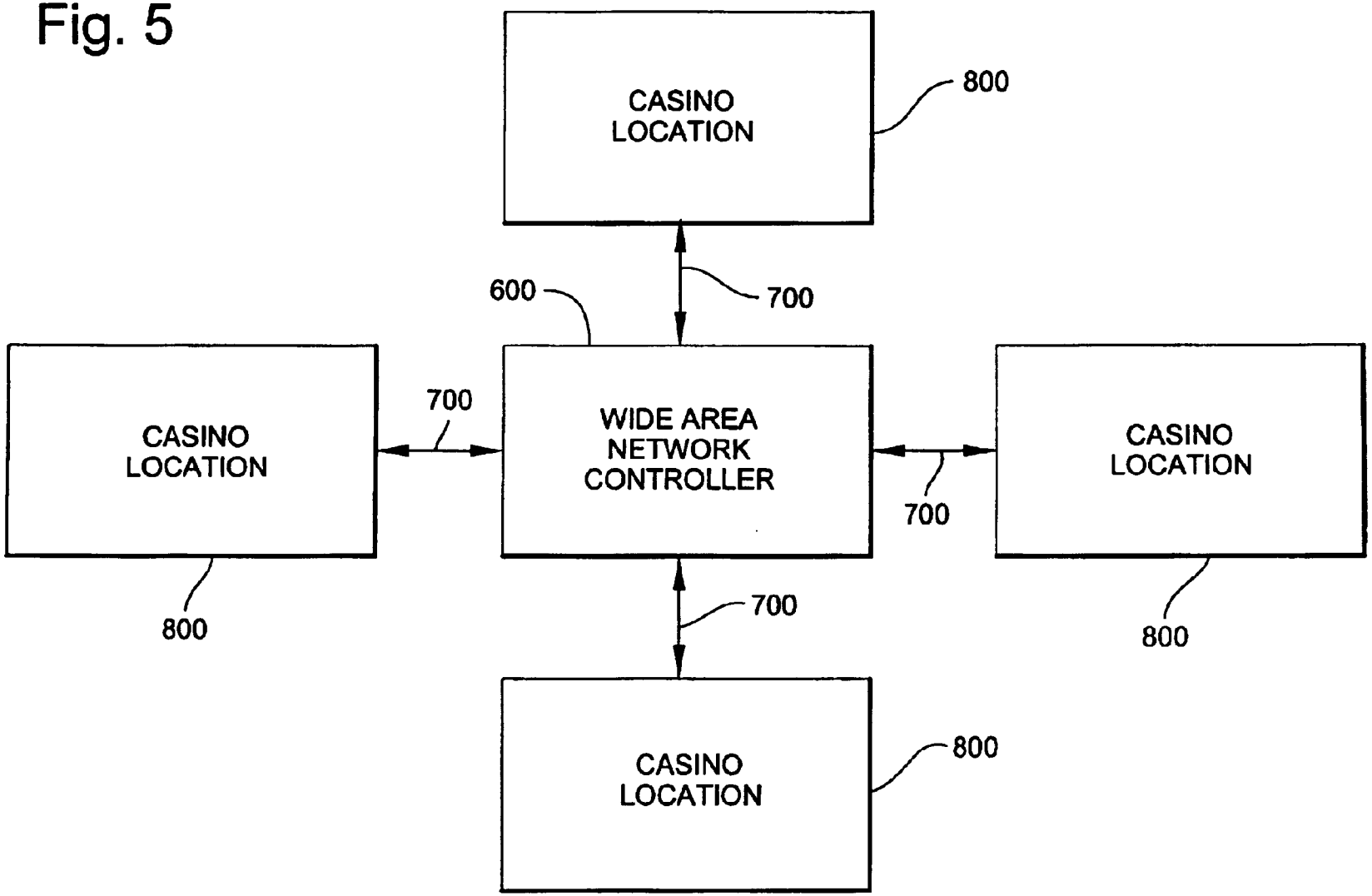
FIG. 5 is a block diagram illustrating another embodiment of the gaming system of FIG. 4.

The wide-area controller realized by host computer 200 and database 300 can be located within a casino or located at a remote location. If this wide-area controller is located at a remote location, then it can serve a plurality of casinos. Such a configuration is shown in FIG. 5. Wide-area controller 600 generally comprises a host computer and data base, similar to host computer 200 and data base 300, both of which being previously described herein. In this configuration, the host computer and data base have operational capacities and memory storage capacity to process, handle, route and organize data associated with thousands of gaming systems (i.e. such as gaming system 100). Wide-area controller 600 is in data communication with data communication links 700. Each data communication link 700 is in data communication with a central computers located at each casino location 800. Each data communication link 700 can be configured as a dedicated data line, microwave network, or satellite network.

In the configuration shown in FIG. 5, accounting functions and player tracking can be implemented by wide-area network controller 600. Wide-area network controller 600 also routes or re-transmits data representing live or prerecorded lottery games to casinos 800 (or any other establishment having a gaming machine 500). Such data is can be fed directly to the host or central computer in each casino 800. The host or central computer then feeds the data into interface connectors 48 (see FIG. 3). In another embodiment, lottery data transmitted from wide-area network controller 600 is transmitted over data communication link 700 and is fed directly into interface connector 60 (see FIG. 3). Such data is then inputted into control module 40 which then controls the other components of lottery game device 10 in accordance with the lottery data.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A gaming apparatus comprising:

an electronic gaming machine having operational control circuitry and a player interface to allow a player to play the electronic gaming machine;

a lottery game module in electronic data communication with the operational control circuitry of the electronic gaming machine and comprising microprocessor means to graphically generate a lottery drawing upon the occurrence of a predetermined event on the electronic gaming machine and means for storing data defining at least one predetermined event that must occur on the electronic gaming machine in order for the microprocessor means to graphically generate the lottery drawing;

a display device to display the graphically generated lottery drawing;

means for activating the lottery game module to graphically generate the lottery drawing upon the occurrence of the predetermined event on the electronic gaming machine;

an interface in communication with the lottery game module to allow a player to input desired lottery numbers and play the graphically generated lottery drawing when the lottery game module is activated; and means for indicating the player has won the lottery drawing.

2. A gaming machine configured to generate a casino game of chance and a simulated lottery drawing:

electronic circuitry means configured to generate a casino game of chance and a simulated lottery drawing;

a player interface that allows a player to play the casino game of chance;

data storage means for storing data defining at least one predetermined event that must occur during play of the casino game of chance in order for the electronic circuitry means to generate the simulated lottery drawing;

means for controlling the electronic circuitry means to generate the simulated lottery drawing upon the occurrence of the predetermined event;

an interface in communication with electronic circuitry means to allow a player to input desired lottery numbers and play the simulated lottery drawing when the controlling means controls the electronic circuitry means to generate the simulated lottery drawing;

a display device to display the simulated lottery drawing; and means for indicating the player has won the lottery drawing.

* * * * *